US005297834A

United States Patent [19]

Vanarnem

[11] Patent Number: 5,297,834

[45] Date of Patent: Mar. 29, 1994

[54] METHOD FOR LIFTING AND TRANSFERRING A DISABLED PERSON TO AND FROM A WHEELCHAIR

[76] Inventor: Heidi L. Vanarnem, 6139 Dakota Cir., Birmingham, Mich. 48010

[21] Appl. No.: 770,418

[22] Filed: Oct. 3, 1991

[51] Int. Cl.[5] ..... A61G 1/00

[52] U.S. Cl. ..... 294/140; 294/152; 5/89.1

[58] Field of Search ..... 294/140, 152, 156, 74; 5/81.1, 89.1, 625, 627

[56] References Cited

U.S. PATENT DOCUMENTS

| | | | |
|---|---|---|---|
| 869,325 | 10/1907 | Oehrmann | 294/140 |
| 2,835,902 | 5/1958 | Fash | 5/627 |
| 4,157,593 | 6/1979 | Kristensson | 5/81.1 |
| 4,536,903 | 8/1985 | Parker | 5/81.1 |
| 4,793,008 | 12/1988 | Johansson | 5/81.1 |
| 4,944,057 | 7/1990 | Shaw | 5/89.1 |

*Primary Examiner*—David M. Mitchell
*Assistant Examiner*—Dean J. Kramer
*Attorney, Agent, or Firm*—Dykema Gossett

[57] ABSTRACT

A method and apparatus for lifting and transferring a disabled person to and from a wheel chair includes an elongated sheet of material having handles at each end. This sheet of material is spread beneath the buttocks of a seated disabled person. An attendant reaches for the handles to either side of the person and straightens up to lift the person slightly from the place at which the person is seated. The attendant pivots on one foot to swing the person to a new location to be seated and bends over to allow the person to be seated in that location. The attendant either leaves the elongated sheet of material beneath the buttocks of the person for a later lifting and transferring or slides it from beneath the buttocks to leave the person freely seated in the new location. These steps may be taken to place a person in a wheel chair from a seated position or vise versa.

5 Claims, 3 Drawing Sheets

METHOD FOR LIFTING AND TRANSFERRING A DISABLED PERSON TO AND FROM A WHEELCHAIR

BACKGROUND OF THE INVENTION

1. Field of the Invention

The present invention relates to lifting and transferring disabled persons from one resting place to another. More particularly, the present invention relates to an apparatus that may be used to lift a disabled person and to transfer the person to and from a wheelchair, from and to a stationary chair, bed, or automobile seat or the like. The present invention also relates to the method by which the apparatus is to be used.

2. Description of the Prior Art

Any number of methods and systems have been used to lift and transfer disabled persons, that is, persons disabled in the sense that they are not able to move themselves. Some patent references teach the concept of a lifting device that would be always positioned beneath a person while that person is seated and that would be available for an attendant to lift the person by grasping the device to either side of the person and lifting.

U.S. Pat. No. 2,835,902 issued to Fash on May 27, 1958, discloses a lifting sheet for lifting and handling a person who is not able to move about under his or her own power. The form of construction of the Fash lifting sheet is especially designed for use in lifting a patient from a wheelchair to a table, bed, or the like. The lifting sheet is formed of a suitable fabric having the desired tensile strength to support the weight of the body to be lifted, carried, or moved about. The sheet is preferably rectangular in plan view. It has elongated slips which extend inwardly from an edge portion that, when placed on a chair, would be most proximate the shoulders of the person being lifted and handled. It also has arm sleeves into which the arms of attendants may be slid. Near the arm sleeves are parallel slits which provide straps to be grasped by the hands. This device does not have handles extending from the sheet, but rather within the sheet's boundary. The structure of this device is particularly adapted for use by two cooperating attendants, which is a disadvantage for a single attendant.

U.S. Pat. No. 3,859,677, issued to Nordwig on Jan. 14, 1975, discloses a substantially rectangular sheet of flexible material which has aligned loops formed along opposite edges for receiving a pair of rigid, elongated handles. The loops are spaced apart so that hands may be inserted for grasping or lifting the device. This device essentially teaches using an elongated sling as a lifting seat which extends between handles at opposite ends. As a drawback, this device depends on the structure of the rigid bar handles for lifting, which would be difficult to slide beneath a person seated in a wheel chair and uncomfortable for the person so seated while the device is put in place for use.

U.S. Pat. No. 4,716,607 issued to Johansson, on Jan. 5, 1988, discloses a patient transfer mat for aiding and moving a patient who cannot move himself or herself. The teaching is particularly adapted to using two mats, one of which would be placed under the buttocks of a patient, while the other would be placed under the shoulder of the patient. The method of using this device is to move the patient by sliding of lifting the patient while the patient is in a stretched out position and does not contemplate use of the device to transfer a patient from one sitting position to another and so is not particularly adapted for use with a wheel chair.

U.S. Pat. No. 4,723,327 issued to Smith on Feb. 9, 1988, discloses a device to transport and move bedridden patients easily and securely without potential injury to either the patient or the attendant. The device is a generally square sheet of flexible fabric material. An integral perimeter handle is movably positioned within the fabric. This device is contemplated for use with a bed ridden patient, and there is no teaching in the reference suggesting a methodology for lifting and transferring a person using a wheelchair.

U.S. Pat. No. 4,737,997 issued to Lamson on Apr. 19, 1988, discloses a method of moving a person from a bed to a wheelchair. Lamson employs a seat section and a conveyor section. What is of particular interest is that the seat section is left in place once the person is positioned in the wheelchair. But while this teaching of leaving a transporting device in place in a wheelchair is now known in the art, the particular structure called for by Lamson requires a special, and not a standard wheelchair for its use. The methodology taught by Lamson also requires the specialized wheelchair equipment.

OBJECTS OF THE INVENTION

The disadvantage with all of the above lifting and transfer apparatus is that they are not adapted for efficient use with a standard wheelchair. This disadvantage is obviated by the present invention, one object of which is to provide a lifting and transferring apparatus that may be used with any standard wheelchair, including motorized wheel chairs.

It is also an object of the present invention to provide a lifting and transferring apparatus that is simple in construction and use and inexpensive to construct and use.

It is yet another object of the present invention to provide a lifting and transferring apparatus that can be used by only one attendant.

Still another object of the present invention is to provide a lifting and transferring apparatus that may be easily slid into place beneath the buttocks of a person who is unable to move to receive the device and that may be left in place beneath the person without being an irritant.

Yet still another object of the present invention is to provide a lifting and transferring apparatus that is always available for an attendant to lift a disabled person and to transfer the person to and from a wheelchair, from and to a stationary chair, bed or automobile seat or the like.

Still yet another object of the present is to provide a method by which the apparatus is to be used by one attendant in a quick and efficient manner.

SUMMARY OF THE INVENTION

In accomplishing the above objects, the present invention is an apparatus and a method for moving a person easily and securely without potential injury to either the person or the attendant moving the person. The apparatus is an elongated sheet of thin, flexible fabric material with handle portions attached to opposite ends of the extension of the material. The method includes positioning the apparatus in a wheelchair beneath a persons buttocks, with the ends of the apparatus extending to either side of the person beyond the hips of the person. If of sufficient length, the ends may drape over the armrests of the chair so that the handles are accessible to both sides of the person. The person seated in the chair shifts or is shifted forward to lean against the thigh of the attendant. The attendant bends over the person being lifted and gently lifts and swings the person to a new location, pivoting on the foot of the leg against which the person leans. The person having been swung to a chair, seat or bed may be positioned with the apparatus in place and the handles accessible for subsequent lifting.

The present invention is preferably made of a light weight, thin material, such as is used for parachutes. This kind of material may be folded or drawn into a belt or rope-like configuration for ease in sliding it beneath a seated person. In this manner, the apparatus may be easily established beneath the seated person's buttocks.

DETAILED DESCRIPTION OF THE PREFERRED EMBODIMENT

Figure 1:
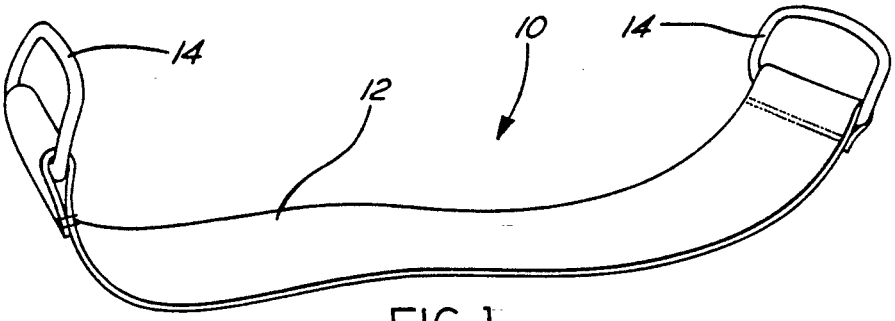
FIG. 1 is a perspective view of the embodiment of the present invention as ready for utilization.
Figure 8:
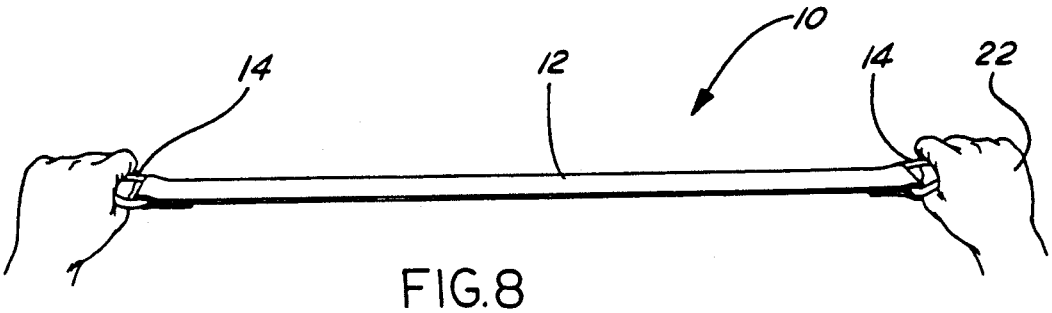
FIG. 8 is a detail of the embodiment of FIGS. 1 and 7 as the invention is drawn into a belt or rope-like configuration.
Figure 9:
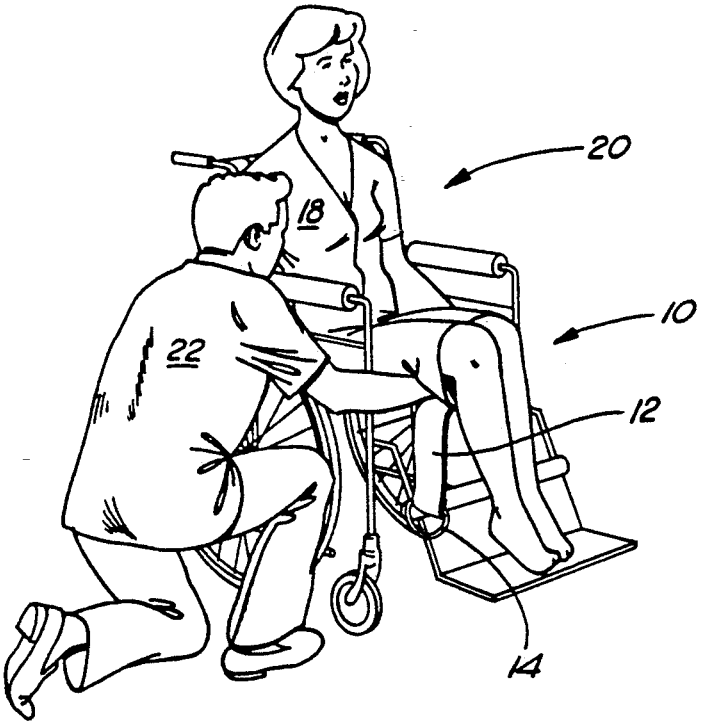
FIG. 9 is a perspective of the attendant sliding the embodiment of FIG. 8 beneath the person seated in the wheel chair.

Referring first to FIG. 1, the apparatus for lifting and transferring a disabled person to and from a wheelchair is designated generally by the reference numeral 10. The lifting and transferring apparatus 10 has an elongated sling 12. Preferably, the sling 12 is made of a cotton material for breathing, such that a person may sit upon the sling 12 without being insulated from the seat on which the person is seated. More preferably, the sling 12 is made of the material out of which parachutes are made, which is light weight and, when folded or drawn into a belt or rope-like configuration as shown in FIG. 8, may be easily slid beneath a seated person and does not gather sufficient body to be an irritating lump.

The lifting and transferring apparatus 10 also has handles 14 which are attached to either longitudinal end of the sling 12. Preferrably, the handles, also, are made of a material of the same consistency. except that the handle structure has the material preferably doubled over for strength over a reduced cross-section. Handles 14 are preferable stitched to sling 12.

Figure 2:
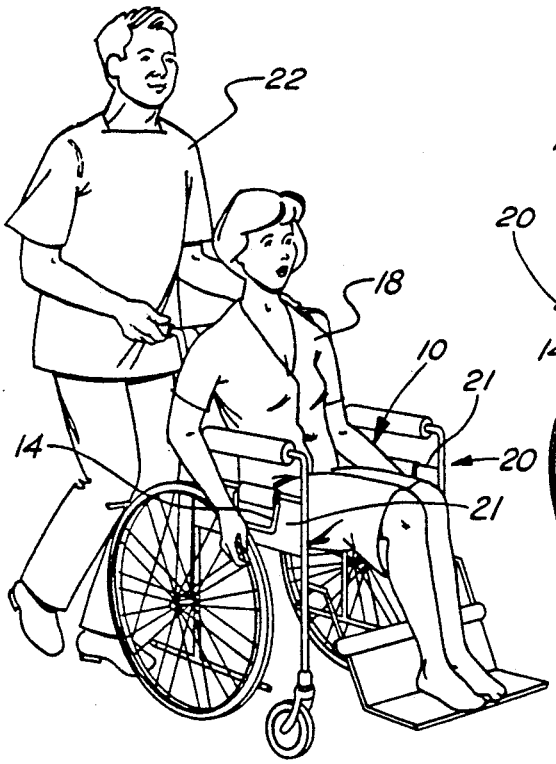
FIG. 2 is a perspective of a person in a wheel chair being pushed by an attendant, with the present invention in place for utilization.
Figure 3:
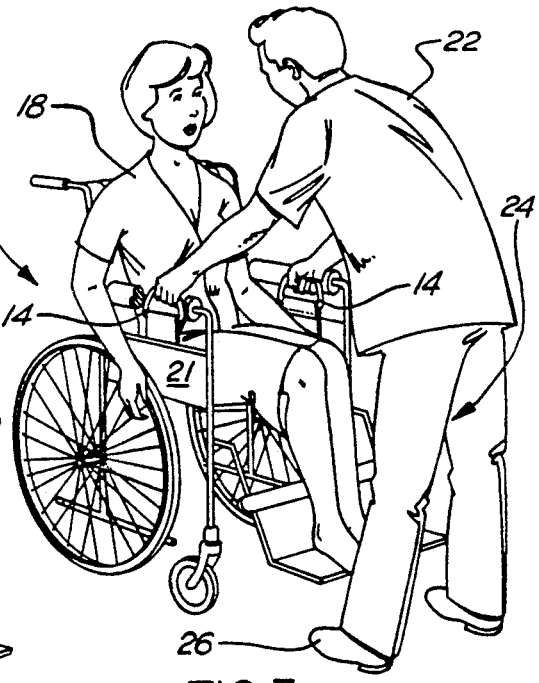
FIG. 3 is a perspective of the attendant positioning himself to lift the person in the wheel chair in accordance with another aspect of the invention.
Figure 7:
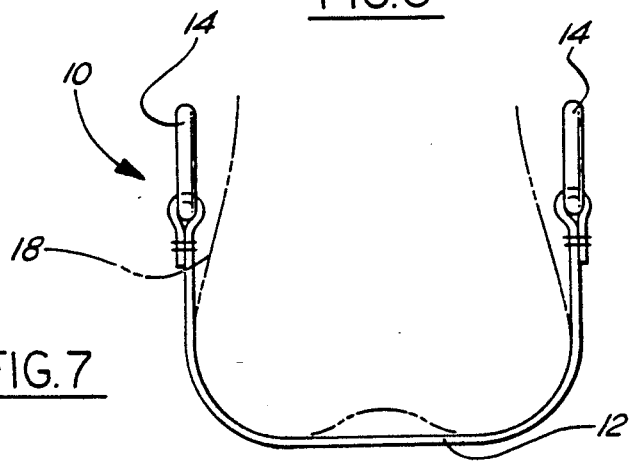
FIG. 7 is an elevation of the embodiment of FIG. 1, positioned with respect to the buttocks of the person lifted in accordance with other aspects of the invention.
Figure 4:
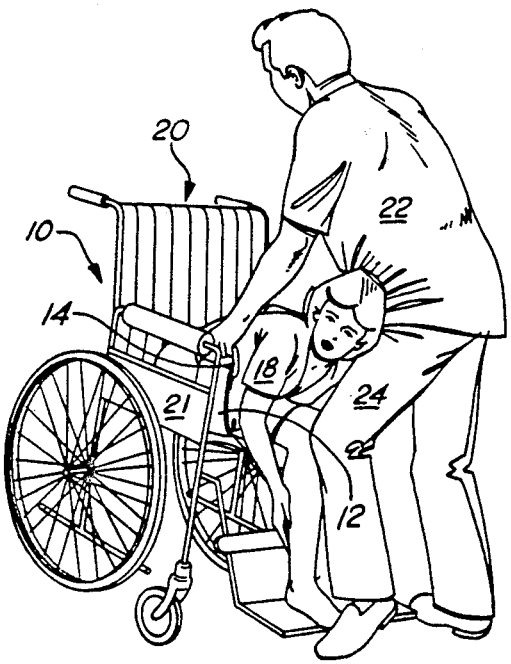
FIG. 4 is a perspective of the person in the wheel chair positioning herself in accordance with another aspect of the invention.

Referring now to FIGS. 2-5, the shifting or moving of a person 18 onto and out of a wheel chair 20 by an attendant 22 is best illustrated. As illustrated in FIG. 2, the person 18 is preferably seated in the wheel chair 20 with the sling 12 of the lifting and transferring apparatus 10 beneath the person 18 so that the person 18 is seated on the sling 12 of the lifting and transferring apparatus 10. The handles 14 extend beyond the hips of the person 18. If of sufficient length, the handles may be draped over the arm rests or seat sides 21 of the wheel chair 20, as shown. If, initially, the lifting and transferring apparatus 10 is not under the person 18 in the wheel chair 20, the lifting and transferring apparatus 10 may be easily slid beneath the person 18 as the fabric is light weight and supple enough to be drawn into a rope-like configuration shown in FIG. 8, slid beneath the person 18, and spread beneath the buttocks of the person 18 so that it is situated as shown in FIG. 7.

Figure 6:
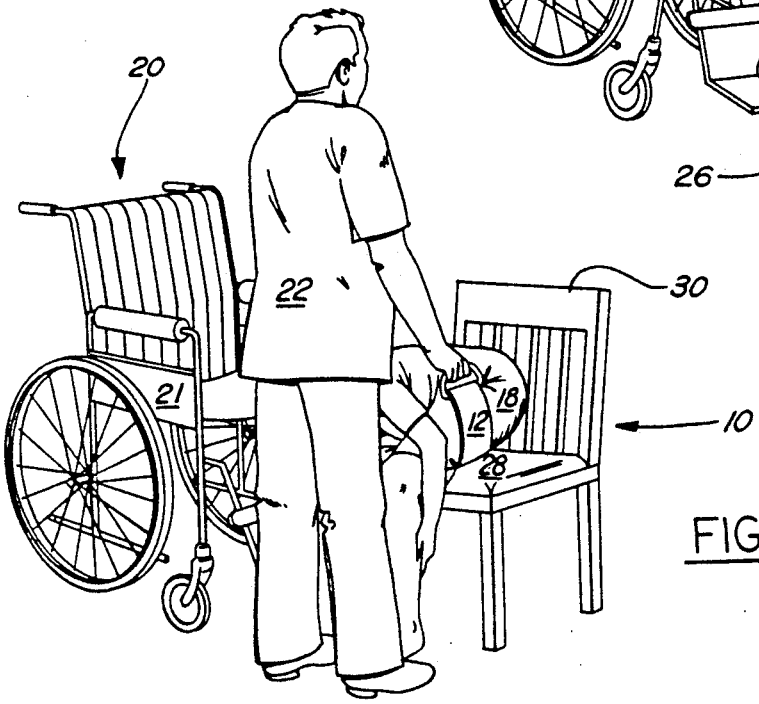
FIG. 6 is a perspective of the attendant depositing the person after he has pivoted to place the person over a chair seat in accordance with other aspects of the invention.

To accomplish lifting and transfer, for example, from the wheel chair 20 to the chair 30 of FIG. 6, the attendant 22 stands generally in front of the wheel chair 20 and reaches, generally by bending over, to grab the handles 14 of the lifting and transferring apparatus 10. The person 18 bends forward at the waist (or is helped into this posture). The attendant 22 presents his or her thigh 24 to cradle the thigh 24 against the shoulder of the person 18.

Figure 5:
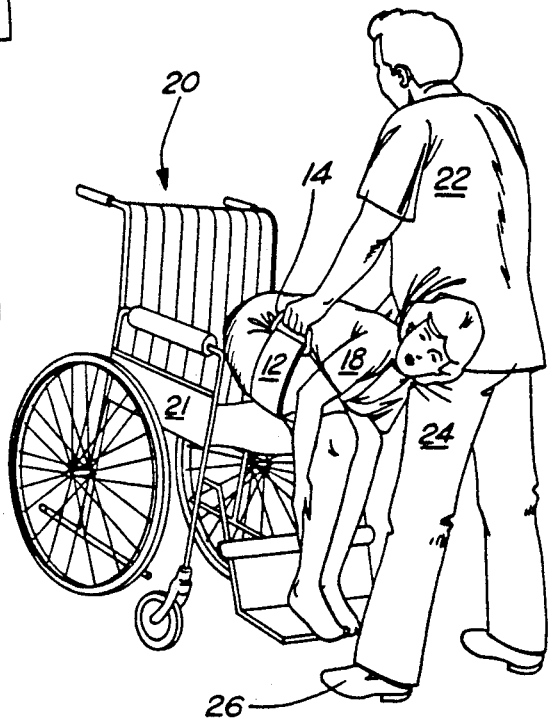
FIG. 5 is a perspective of the attendant lifting the person from the wheel chair.

As shown in FIG. 5, the attendant straightens from the bending posture and/or lifts the person 18 by straightening with the person 18 against the attendant's thigh 24. Pivoting on the foot 26 of the leg with the thigh 24 that the person leans against, the attendant turns to place the person 18 over the seat 28 of the chair 30. This is shown in FIG. 6. The attendant may thereafter leave the lifting and transferring apparatus 10 beneath the person 18 or may slide the lifting and transferring apparatus 10 from beneath the person 18 by grabbing on of the handles 14 and pulling the lifting and transfer apparatus 10 from beneath the person 18. Repositioning the lifting and transferring apparatus and lifting and transferring the person 18 back to the wheel chair will involve the same steps that were discussed with respect to lifting the person 18 from the wheel chair 22 to the chair 26.

Thus the present invention provides a light weight portable, and washable lifting and transferring apparatus 10 constituted preferably of a cotton parachute material. Such a lifting and transferring apparatus 10 may be carried about by the attendant 22 or the person 18 or placed in a convenient location for its use. The method of its use is a novel method for lifting and transferring a patient with little strain on the attendant. From the above description of the apparatus and method of the present invention, it will be evident that many modification thereto will become apparent to those skilled in the art to which it pertains without departing from the scope and spirit of the appendant claims.

I claim:

1. A method of lifting and transferring a disabled person by an attendant using an elongated sheet of material having two ends, comprising the steps of:

placing the person in a sitting position with the elongated sheet of material beneath the buttocks of the person so that each end of the elongate sheet is at a respective side of the person seated;

bending the person over so that the person's shoulder is against the attendant's thigh;

the attendant grabbing the ends of the elongate sheet of material on each side of the person seated and lifting the person by pulling up on said ends of the elongate sheet of material, with said shoulder against the attendant's thigh while the attendant straightens to a standing posture;

the attendant pivoting on one foot to the direction of a place to which the person will be transferred;

the attendant depositing the person so that the person is seated in said place; and the attendant releasing the ends of the sheet of material so that the person is now seated in a new position.

2. The method of claim 1, wherein the step of placing the person in a sitting position with the elongated sheet of material beneath the buttocks of the person comprises the substep of sliding the elongate material beneath the person seated.

3. The method of claim 2 further comprising the step of sliding the elongate sheet of material from beneath the person after the person has been deposited.

4. The method of claim 1 wherein the step of placing the person in a sitting position with the elongated sheet of material beneath the buttocks of the person comprises the substeps of drawing the elongate sheet of material into a belt and sliding the elongate material beneath the person seated.

5. The method of claim 1, wherein the sheet of material has handles at each end thereof and grabbing said ends includes grabbing said handles, pulling up on said ends includes pulling up on said handles, and releasing said ends includes releasing said handles.

* * * * *